United States Patent [19]

Michel

[11] Patent Number: 4,504,061

[45] Date of Patent: Mar. 12, 1985

[54] SPACE TRAVEL GAME

[76] Inventor: Walter F. Michel, Rte. 1, Box 12A, Westover, Md. 21871

[21] Appl. No.: 451,731

[22] Filed: Dec. 20, 1982

[51] Int. Cl.[3] ..... A63F 3/00

[52] U.S. Cl. ..... 273/250; 273/253

[58] Field of Search ..... 273/250, 251, 252, 253, 273/254, 243, 246, 249

[56] References Cited

U.S. PATENT DOCUMENTS

| | | | |
|---|---|---|---|
| 1,406,691 | 2/1922 | Sewell | 273/249 |
| 1,538,134 | 5/1925 | Muir | 273/235 |
| 1,572,254 | 2/1926 | Tornes | 273/249 |
| 1,642,711 | 9/1927 | Alfonso | 273/249 |
| 2,990,181 | 6/1961 | Lippold | 273/250 |
| 3,099,451 | 7/1963 | Newhouse | 273/253 |
| 3,223,420 | 12/1965 | Turner | 273/253 |
| 3,373,995 | 3/1968 | Fors | 273/250 |
| 3,514,111 | 5/1970 | Crawford | 273/238 |
| 3,533,628 | 10/1970 | Fisher | 273/250 |
| 3,565,438 | 2/1971 | Bischof | 273/253 |
| 3,617,063 | 11/1971 | Dyer et al. | 273/253 X |
| 3,658,338 | 4/1972 | Wheelock | 273/253 X |
| 3,973,775 | 10/1976 | Bolan et al. | 273/253 |
| 4,111,427 | 9/1978 | Patterson | 273/250 |
| 4,114,891 | 9/1978 | Lawrimore | 273/250 |

FOREIGN PATENT DOCUMENTS

| | | | |
|---|---|---|---|
| 2650545 | 5/1978 | Fed. Rep. of Germany | 273/253 |
| 1526893 | 4/1968 | France | 273/252 |

*Primary Examiner*—William H. Grieb
*Assistant Examiner*—Matthew L. Schneider
*Attorney, Agent, or Firm*—Lane, Aitken & Kananen

[57] ABSTRACT

A game apparatus representing space travel between the earth and moon. The game apparatus comprises a game board having a representation of the earth and moon wherein a plurality of concentric orbits are positioned about the earth and one orbit is positioned about the moon. A plurality of movement paths are provided that connect the earth and its closest orbit, the earth orbits themselves and the moon and its orbit. Movement paths are utilized that connect the outer earth orbit to the moon orbit. The game also includes certain orbit escape spaces and orbit change spaces that allow players to move from one movement path to another. A chance device, instruction cards and player pieces are also provided.

11 Claims, 6 Drawing Figures

FIG. 1B.

FIG. 1A.

FIG. IA.
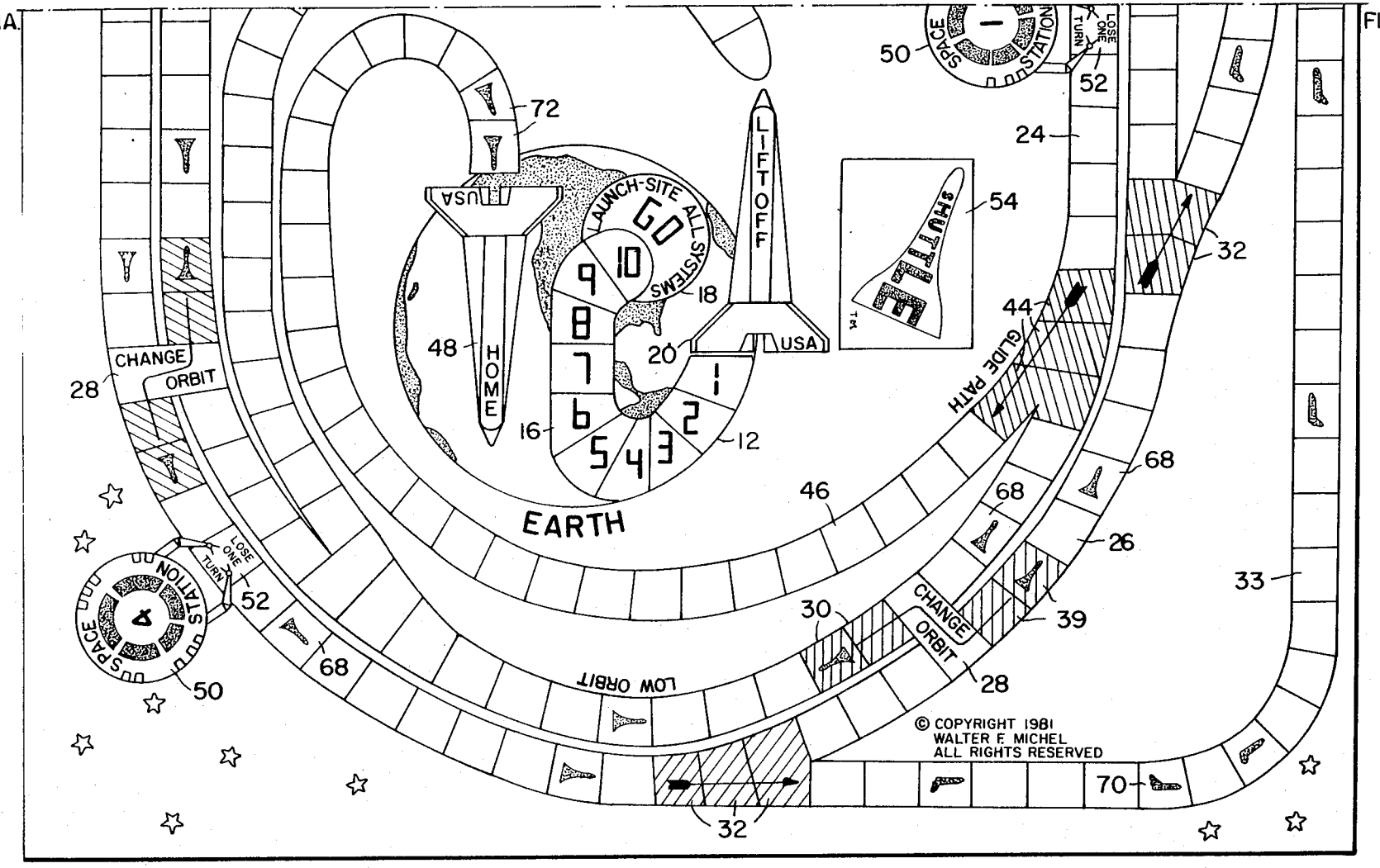
FIG. IB.
FIG. IA.

SPACE TRAVEL GAME

The present invention relates in general to a game device and, more particularly, to a gameboard with associated position markers, game cards, and chance devices.

SUMMARY OF THE INVENTION

The subject game includes a gameboard having a representation of the earth and its moon, a plurality of orbital paths around the earth, an orbital path around the moon, connecting paths between the earth orbital paths and the moon orbital path and suborbital paths between the earth and its orbital paths. The paths comprise a plurality of serial spaces or positions and the movement of shuttle position markers along the paths is determined by a chance device, such as a pair of dice. The game involves travel from the earth to an inner earth orbit and travel around the inner earth orbit until the chance device directs the movement of a shuttle position marker to a specially designated position indicating a change of orbit from the inner earth orbit to an outer earth orbit. Travel continues around the outer earth orbit until the chance device directs the movement of a shuttle position marker to a specially designated position indicating escape from the outer earth orbit to one of a plurality of connecting paths between the outer earth orbit and the moon orbit. Travel continues around the moon orbit until a shuttle position marker lands on a position designated for landing on the moon. Return travel takes place in a similar manner until all but one of the shuttle position markers arrives back at earth.

Specially designated positions along the paths instruct players to take and follow the instructions on one of two sets of instruction cards. The instructions on at least some of the instruction cards direct a player to collect a merit point card on the back of which a representation of one of various merit point values is contained. Merit point cards are also awarded for landing on the moon, and bonus point cards are awarded for being the first to land on the moon and the first to return to earth. The winner of the game is the player who has accumulated the largest number of merit points when all but one of the shuttle position markers has returned to earth. In the event of a tie for the highest score, the tied player who returned to earth first is the winner.

BRIEF DESCRIPTION OF THE DRAWINGS

Further objectives of the invention, together with additional features and advantages thereof, will be apparent from the following description of one embodiment of the invention when read in conjunction with the accompanying drawings, wherein.

DETAILED DESCRIPTION OF THE PREFERRED EMBODIMENT

Figures 1A, 1B:
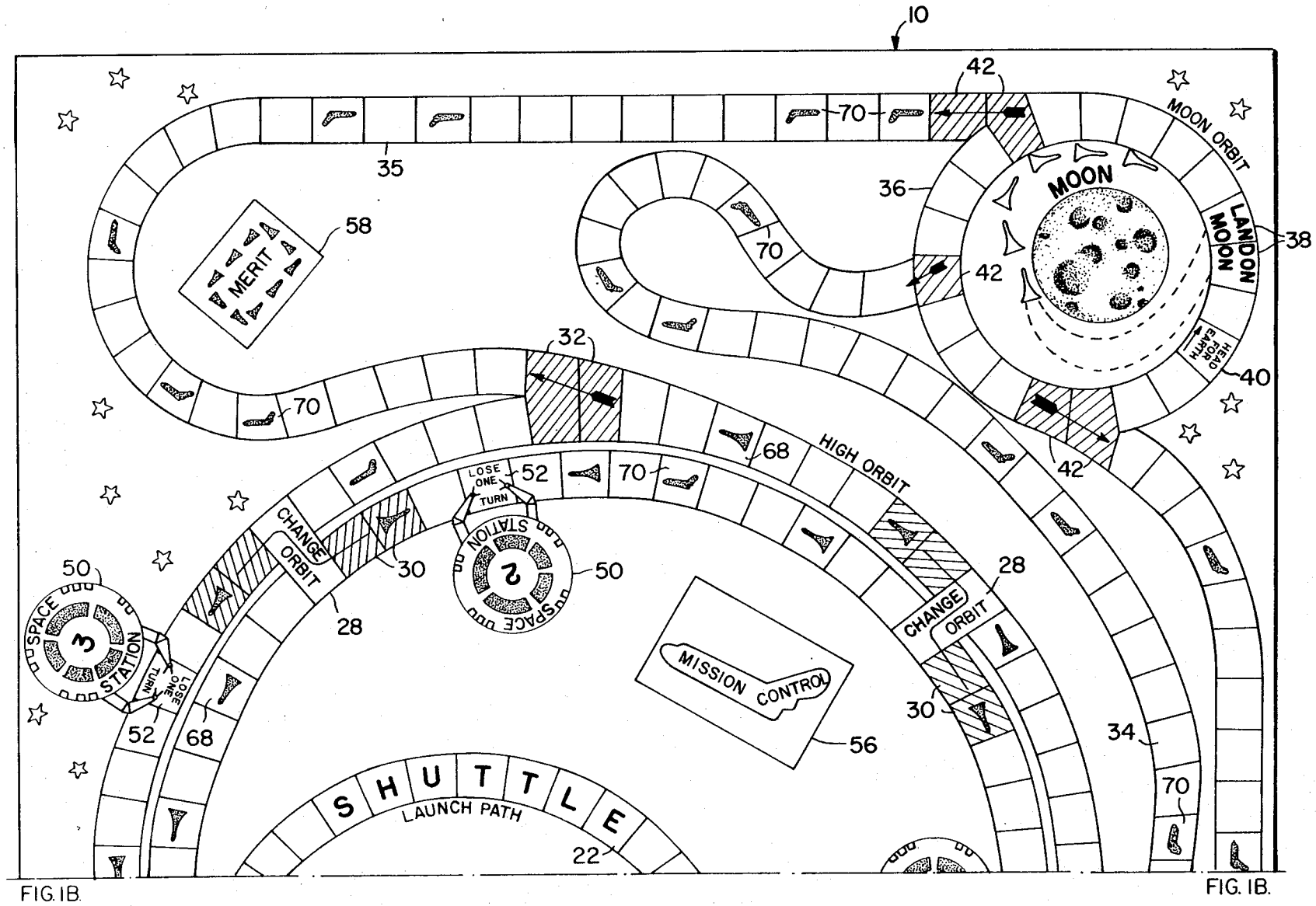
FIG. 1A is a plan view of one half of the gameboard of the subject invention.
FIG. 1B is a plan view of the other half of the game board of the subject invention.

As can be seen from FIGS. 1A and 1B, the gameboard, which is generally designated by the reference numeral 10, includes a representation of the earth 12, its moon 14, and a plurality of paths which include generally regularly-spaced serial positions. A 10 position countdown path 16 is designated on the earth between a "GO" starting position 18 and a liftoff position 20 which bridges the countdown path 16 with a sub-orbital launch path 22. The sub-orbital launch path 22 leads to a low earth orbit 24, which is connected to a high earth orbit 26 by a plurality of specially designated change orbit positions or spaces 28. The change orbit spaces 28 are positions which bridge the low earth orbit 24 and the high earth orbit 26. Immediately preceding each of the change orbit spaces 28 in the low earth orbit 24 are specially designated, such as by stripes, auxiliary change orbit spaces 30. In the high earth orbit 26 are a plurality of specially designated, as by stripes and/or different coloring, orbit escape spaces 32 which connect the high earth orbit 26 with a plurality of connecting paths 33, 34 and 35 leading to a moon orbit 36. The connecting path 35 is shorter than the connecting paths 33 and 34, and the connecting path 33 is connected to the high earth orbit 26 by more orbit escape spaces 32 than the connecting paths 34 and 35. The moon orbit 36 has a plurality of spaces 38 instructing the player to land on the moon 14.

Return travel from the moon 14 employs a space 40 designated "head for earth" as a starting point, which is contained in the moon orbit 36, as are a plurality of orbit escape spaces 42 which are the first positions, in the return direction, in the connecting paths 34 and 35 between the moon orbit 36 and the high earth orbit 26. The high earth orbit 26 contains the change orbit spaces 28 as well as auxiliary change orbit spaces 39, which precede the change orbit spaces 28 in the return direction. The low earth orbit 24 contains orbit escape spaces 44 leading to a sub-orbital glide path 46 back to a home position 48 on earth 12.

Figure 2:
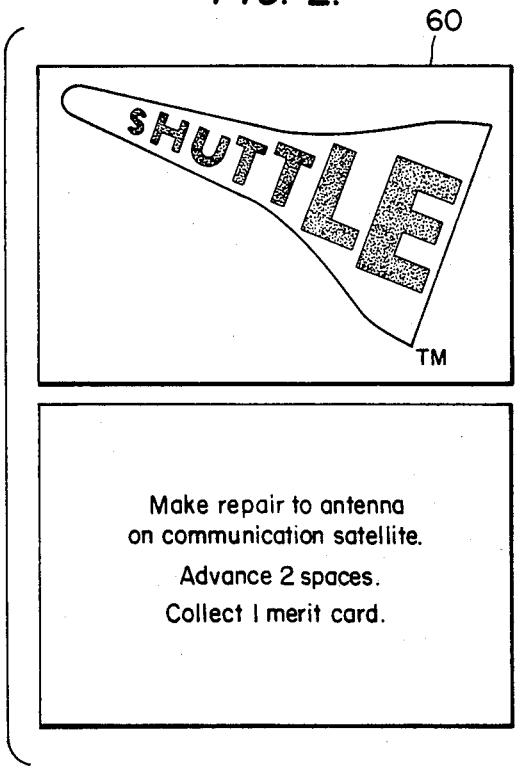
FIG. 2 is a plan view of opposite sides of an illustrative shuttle instruction card incorporated in the game according to the present invention.
Figure 3:
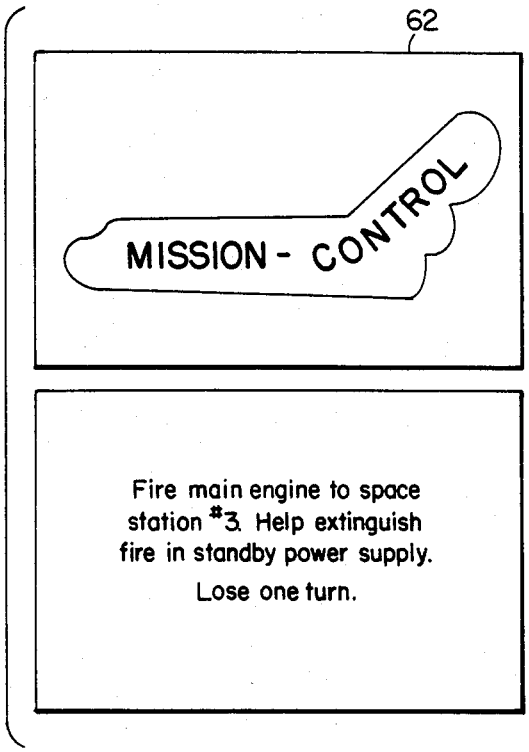
FIG. 3 is a plan view of opposite sides of an illustrative mission control instruction card incorporated in the game according to the present invention.
Figure 4:
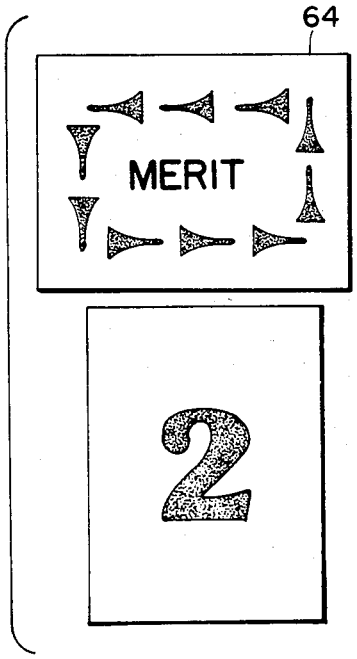
FIG. 4 is a plan view of opposite sides of an illustrative merit point card used in the game according to the present invention.
Figure 5:
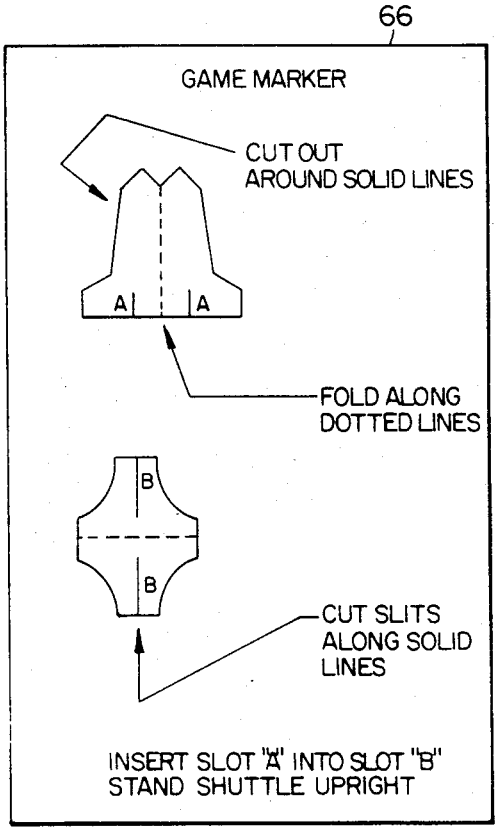
FIG. 5 is a plan view of game marker card from which a position marker used in the game according to the present invention may be constructed.

The board 10 also contains a representation of a plurality of space stations 50 which are adjacent to specially designated positions 52 in the paths. Several areas 54, 56 and 58 on the playing board are designated for the placement of various decks of playing cards, which are designated shuttle instruction cards, mission control instruction cards and merit point cards, respectively. The front and back sides of an illustrative shuttle instruction card 60, mission control instruction card 62 and merit point card 64 are shown in FIGS. 2–4, respectively, and will be described in more detail hereinafter. As can be seen from FIG. 5, the game also includes a plurality of game marker cards 66 of various colors, from which position markers in the form of space shuttles can be constructed. The paths contain a plurality of positions 68 and 70 marked with a symbol corresponding to the symbol on the back of a shuttle instruction card 60 and a mission control instruction card 62, respectively, indicating that a shuttle instruction card or a mission control instruction card is to be removed from the top of the associated deck of cards. A chance device, such as a conventional pair of dice, each having sides marked with from 1 to 6 dots, is included in the game.

In play, each player receives one shuttle position marker, and all players place their shuttle position markers on the earth in the starting position 18, which is marked "launch-site all systems go". Each player rolls the dice once and the player with the highest total starts the game, with the turns then moving clockwise among the players. Each player, in his turn, throws the dice and moves his shuttle position marker the number of positions or spaces shown by the total thrown. A player starts counting with the space marked "10" in the countdown path 16 and moves toward the liftoff position 20 which bridges the countdown path 16 with the sub-orbital launch path 22. No two players may occupy the same space, and the player landing on an occupied space moves his own position marker back to the first unoccupied space and follows the rules pertaining to that space.

The players move their position markers from the launch path 22 to the low earth orbit 24 and counterclockwise along the low earth orbit until they land on a change orbit space 28 or an auxiliary change orbit space 30. A player landing on a change orbit space 28 moves his shuttle position mark immediately to the high earth orbit 26, whereas a player landing on an auxiliary change orbit space 30, moves into the high earth orbit 26 on his next roll of dice. Although only two earth orbits and one moon orbit have been described, it is to be understood that additional intermediate earth orbits and additional moon orbits and the appropriate additional change orbit spaces can be provided. Players heading for the moon 14 and moving in the high earth orbit 26, who land on an orbit escape space 32 move their position marker into the associated connecting path 33, 34 and 35 between the high earth orbit 26 and the moon orbit 36. In the embodiment illustrated, more orbit escape spaces 32 are associated with the connecting path 33 than with the connecting paths 34 and 35. From the connecting paths 33–35, the players move into the moon orbit 36 and along the moon orbit until their position markers land on one of the spaces 38 designated "land on moon", whereupon they move their position markers directly onto the moon 14.

A player landing on one of the various positions or spaces 68 and 70 removes a shuttle instruction card 60 or mission control instruction card 62 from the associated deck. Each of these cards contains instructions affecting the player who lands on the space. For example, the illustrative shuttle instruction card 60 illustrated in FIG. 2 directs "Make repair to antenna on communication satellite. Advance 2 spaces. Collect 1 merit card." The player receiving such a card would take one merit point card and move forward 2 spaces, following any instructions associated with the new space. The mission control instruction card 62 shown in FIG. 3 instructs "Fire main engine to space station #3. Help estinguish fire in standby power supply. Lose one turn." The player receiving this card would move to the named space station and wait out one turn there. Such instructions in both the shuttle cards and the mission control cards include losing a turn, going ahead or back a certain number of spaces, collecting one merit point card, or a combination of these.

The merit point cards 64 have designated on the back thereof point values of varying amounts, as is exemplified by the merit point card 64 of FIG. 4. In the game illustrated, the merit point cards 64 have point values of 1, 2 or 3 points. The player collecting the card keeps it and does not disclose the number of points. Merit point cards 64 are also awarded for landing on the moon 14 and a bonus merit card is awarded to the first player landing on the moon. In addition, two merit point cards are awarded to the first player returning to earth. Note that no positions in the paths are designated for the collection of merit point cards 64, and except for landing on the moon and first to return to earth, merit cards are only collected as the result of following the directions of some of the shuttle instruction cards 60 and mission control instruction cards 62.

A player landing on a position 52 or space adjacent to a space station 50 moves his position marker onto the space station 50 and loses one turn. When a player leaves the space station 50, the associated space 52 or position is counted as the first space.

Players leaving the moon 14 start in the space 40 designated "head for earth" in the moon orbit 36 and move counterclockwise in the moon orbit until their position markers land on an orbit escape space 42 which leads to one of the connecting paths 33–35 to the high earth orbit 26. Players move along the connecting paths 33–35 and into the high earth orbit 26, in which they continue until they land on a change orbit space 28 or an auxiliary change orbit space 39, whereupon they move into the lower earth orbit 24. Players continue to move in the low earth orbit 24 until they land on one of the orbit escape spaces 44 which lead to the sub-orbital glide path 46 back to the home position 48 on earth 12. Players land back on earth 12 either by throwing the exact number to land on the home position 48 or by landing on one of two specially designated spaces 72 prior to the home position. As was mentioned earlier, the first player to land on earth picks up two merit point cards 64 from the top of the deck. All other players receive none. All play is completed when only one shuttle position marker remains in space. The last shuttle position marker is sent directly to earth. Upon completion of play, each player counts the values on his merit point cards 64, and the player with the highest score wins the game. In the event of a tie for the highest score, the tied player who landed on earth first is the winner.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. Game apparatus comprising a plurality of position markers, a gameboard having thereon a representation of the earth and its moon, a plurality of concentric orbits around the earth including a low earth orbit and a high earth orbit, whereby said low earth orbit and said high earth orbit do not intersect one another, an orbit around the moon, at least one path connecting the high earth orbit and the moon orbit, at least one sub-orbital path extending between the earth and the low earth orbit, each of said orbits and said paths comprising a plurality of serially arranged positions, at least one change orbit space connecting the low earth orbit and the high earth orbit, said change orbit space comprising a position on said high orbit and a position on said low orbit, whereby a position marker changes from one to another of said orbits by landing on said change orbit space, at least one auxiliary change orbit space associated with each change orbit space, whereby a position marker is enabled to change from one to another orbit by landing on said auxiliary change orbit space and whereby each of said change orbit spaces and the respectively associated at least one auxiliary change orbit space are serially arranged in an unvarying change orbit path such that a marker moving from one orbit to another traverses said change orbit path, at least one orbit escape space in each of the high earth orbit and the moon orbit for providing access to the connecting paths, and chance means for directing the movement of the position markers along said paths and orbits by a variable number of positions.

2. The game apparatus of claim 1, wherein said orbit escape space comprises a position on a respective orbit and a position on a respective path, whereby a position marker changes from said respective orbit to said respective path or from said respective path to said respective orbit by landing on said orbit escape space.

3. The game apparatus of claim 2, wherein there are a plurality of paths connecting the high earth orbit and the moon orbit, at least one of said paths being shorter than the other paths, such that said shorter path is accessible through a smaller number of serially arranged orbit escape spaces than said other paths such that a marker moving from an orbit to a path traverses all of the orbit escape spaces associated with the path.

4. The game apparatus of claim 1 wherein there are two sub-orbital paths, including a launch path for use by position markers moving from earth to the low earth orbit and a glide path for use by position markers moving from the low earth orbit to earth.

5. The game apparatus of claim 1 wherein there are a plurality of paths connecting the high earth orbit and the moon orbit.

6. The game apparatus of claim 5 wherein one of said connecting paths contains fewer said positions than any other connecting path.

7. The game apparatus of claim 1 wherein said earth comprises a countdown path having a plurality of serially arranged positions through which a position marker must proceed before entering said sub-orbital path.

8. The game apparatus of claim 1 wherein said gameboard is of a unitary construction.

9. The game apparatus of claim 1, further comprising a plurality of merit value cards of various values, a plurality of instruction cards, at least some of which include directions for collecting merit value cards, some of said spaces being marked to require the following to the instructions of an instruction card.

10. The game apparatus of claim 9, wherein at least one merit point card is awarded for the first position marker to land on the moon and for the first position marker to return to earth.

11. The game apparatus of claim 9 wherein the winning player is the one who has collected the most merit points when all but one of the position markers has returned to earth.

* * * * *